US010494783B2

(12) United States Patent
Jarvie

(10) Patent No.: US 10,494,783 B2
(45) Date of Patent: Dec. 3, 2019

(54) EARTH RETENTION LEVEE SYSTEM

(71) Applicant: John Jarvie, Cronulla (AU)

(72) Inventor: John Jarvie, Cronulla (AU)

(73) Assignee: Armour Wall Group Pty Ltd (AU)

( * ) Notice: Subject to any disclaimer, the term of this patent is extended or adjusted under 35 U.S.C. 154(b) by 0 days.

(21) Appl. No.: 15/766,650

(22) PCT Filed: Oct. 12, 2016

(86) PCT No.: PCT/AU2016/000348
§ 371 (c)(1),
(2) Date: Apr. 6, 2018

(87) PCT Pub. No.: WO2017/063020
PCT Pub. Date: Apr. 20, 2017

(65) Prior Publication Data

US 2018/0305883 A1 Oct. 25, 2018

(30) Foreign Application Priority Data

Oct. 13, 2015 (AU) ..... 2015904157

(51) Int. Cl.
*E02D 5/03* (2006.01)
*E02D 29/02* (2006.01)
(Continued)

(52) U.S. Cl.
CPC ..... *E02D 5/03* (2013.01); *E02B 3/06* (2013.01); *E02D 17/18* (2013.01);
(Continued)

(58) Field of Classification Search
CPC ..... E02D 5/02; E02D 5/03; E02D 5/0406; E02D 5/16; E02D 29/041; E02D 29/0241; E02B 3/06; E02B 3/066
(Continued)

(56) References Cited

U.S. PATENT DOCUMENTS 693,235 A * 2/1902 Clark ..... E02D 5/04 405/280
1,742,947 A * 1/1930 Brash ..... E02D 5/04 405/280
(Continued)

FOREIGN PATENT DOCUMENTS

EP 2 597 202 A1 5/2013
JP 11001926 A * 1/1999 ..... E02D 27/40
(Continued)

OTHER PUBLICATIONS

ISA, International Search Report and Written Opinion, International Patent Application No. PCT/AU2016/000348, dated Nov. 23, 2016, 11 pages.
(Continued)

*Primary Examiner* — Frederick L Lagman
(74) *Attorney, Agent, or Firm* — Burns & Levinson, LLP; Shahid Hasan

(57) ABSTRACT

An earth retention levee system is disclosed which is constructed from spaced apart facing parallel walls of interlocking sheet piles (1, 2) said sheet piles having outside faces (5) and inside faces (4) formed with gridspines (10) along a longitudinal extent thereof, said gridspines (10) being connected to adjacent edges of geogrids (20) which link said parallel walls and stabilise fill (21) disposed therebetween.

13 Claims, 4 Drawing Sheets

(51) Int. Cl.
*E02B 3/06* (2006.01)
*E02D 17/18* (2006.01)

(52) U.S. Cl.
CPC .. *E02D 29/0241* (2013.01); *E02D 2300/0006* (2013.01); *E02D 2300/007* (2013.01); *E02D 2300/0045* (2013.01); *E02D 2300/0053* (2013.01); *E02D 2600/20* (2013.01); *E02D 2600/40* (2013.01)

(58) Field of Classification Search
USPC ..... 405/262, 274, 276, 277, 278, 279, 281
See application file for complete search history.

(56) References Cited

U.S. PATENT DOCUMENTS 1,947,151 A 2/1934 Caples
1,988,864 A * 1/1935 Berve ..... B21B 1/082 29/897.3
2,001,473 A * 5/1935 Smith ..... E02B 3/068 405/14
3,720,067 A * 3/1973 Aubert ..... E02B 3/06 405/107
3,925,994 A * 12/1975 Broms ..... E02D 17/20 404/31
4,704,052 A * 11/1987 Aubert ..... E02B 7/02 405/107
5,259,705 A * 11/1993 Breaux ..... B09B 1/008 405/129.8
5,468,098 A * 11/1995 Babcock ..... E02D 29/0225 405/262
6,234,720 B1 * 5/2001 Queen ..... E02D 5/30 405/232
6,715,964 B2 * 4/2004 Nottingham ..... E02D 5/02 405/278
7,025,539 B2 4/2006 Irvine
7,025,540 B2 * 4/2006 MacDonald ..... E02D 5/08 405/274
7,377,726 B2 * 5/2008 Schellhorn ..... E02B 3/06 405/284
2005/0053429 A1 3/2005 Davidsaver et al.
2007/0175583 A1 * 8/2007 Mosallam ..... B29C 70/088 156/307.1
2007/0217870 A1 * 9/2007 Davidsaver ..... E02B 3/06 405/284
2008/0145153 A1 * 6/2008 Wendt ..... E02B 3/108 405/274
2008/0170913 A1 7/2008 Moreau
2008/0274329 A1 * 11/2008 Heindl ..... E02D 5/06 428/99
2009/0188180 A1 * 7/2009 Irvine ..... E04D 3/405 52/169.13
2014/0138427 A1 * 5/2014 Nagatsu ..... E02D 31/002 228/264
2016/0281314 A1 * 9/2016 Eftekharzadeh ..... E02B 7/44

FOREIGN PATENT DOCUMENTS

JP 2002242164 A * 8/2002
NL 9202230 A * 7/1994 ..... E02D 5/02
WO WO 9322506 * 11/1993
WO WO-2010100176 A1 * 9/2010 ..... E02D 27/40

OTHER PUBLICATIONS

Extended European Search Report issued in European Application No. 16854624.0, dated Jul. 1, 2019, 7 pages.

* cited by examiner

EARTH RETENTION LEVEE SYSTEM

CROSS REFERENCE TO RELATED APPLICATIONS

This application is a U.S. national stage application under 35 U.S.C. § 371 of PCT Application No. PCT/AU2016/000348 filed on Oct. 12, 2016, which is published in English under PCT Article 21(2) as WO 2017/063020 on Apr. 20, 2017, which in turn claims the benefit and priority to the Australian Patent Application No. 2015904157, filed on Oct. 13, 2015. The entire contents of each of which are incorporated herein in their entirety by reference for all purposes.

FIELD OF THE INVENTION

This invention relates to earth or fill retaining systems. More particularly, although not exclusively it discloses improvements in levee systems for seawalls, bulkheads, retaining walls and like structures.

BACKGROUND TO THE INVENTION

It is well known to drive prefabricated sheet piles into the ground in interlocking fashion to provide a retaining wall behind which loose fill such as soil or sand is disposed. In order to stabilise and reinforce this fill and to prevent erosion and excessive outward load on the piles it is also known to install horizontal spaced apart grids or mesh which extend back into the fill. This diffuses the outward forces that would otherwise act against the back of the piles by causing the fill to "stack vertically" as opposed to stacking at its natural shallower angle of repose. The outward force imposed against the piles is thus substantially reduced. Such grids or meshes are commonly referred to in the industry as "Geogrids". In addition it has been determined that further benefits to the wall structure can be obtained by connecting the Geogrids directly to the back sides of the piles whereby said piles are "tied back" into the fill.

SUMMARY OF THE INVENTION

Accordingly an earth retention levee system is disclosed which is constructed from spaced apart parallel walls of interlocking sheet piles, said sheet pile having outside faces and inside faces formed with spines along a longitudinal extent thereof, said spines being connected to adjacent edges of Geogrids linking said parallel walls and adapted to stabilise fill disposed therebetween.

Preferably the spines are formed as a continuous flanges extending out from said inside faces with enlarged or bulbous outer edges.

It is further preferred that said sheet pile is in the form of a box section which on installation interlocks with another like pile to create a closed wall structure that can be infilled with concrete for increased strength.

It is further preferred that said sheet pile is formed from a composite material comprising a fibre reinforced polymer.

It is further preferred that said composite material includes reinforcement with biaxial E-glass fabrics, continuous strand glass mat, and aligned unidirectional rovings.

BRIEF DESCRIPTION OF THE DRAWINGS

One currently preferred embodiment of the invention will now be described with reference to the attached drawings in which.

DETAILED DESCRIPTION OF THE PREFERRED EMBODIMENT

Figure 1:
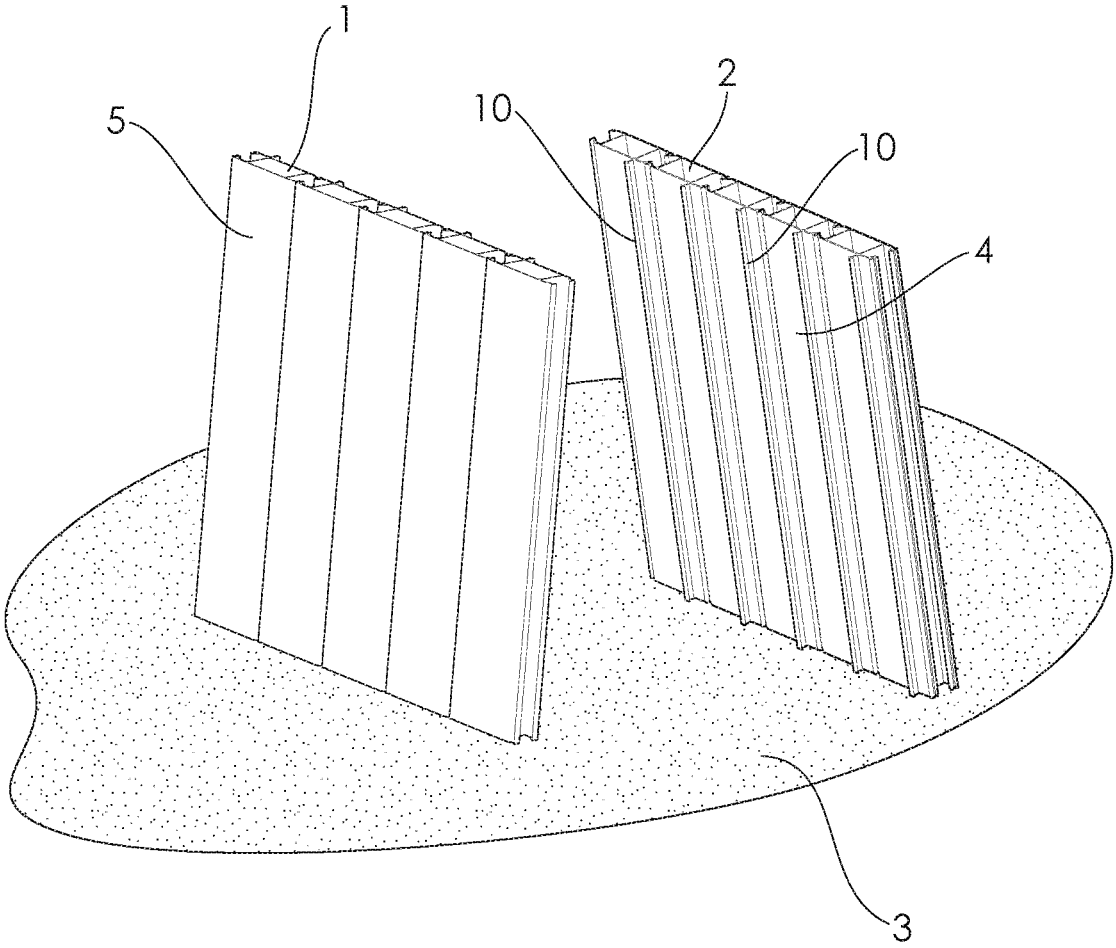
FIG. 1 shows the angled placement of the walls of the Earth Retention Levee System according to the invention.
Figure 2:
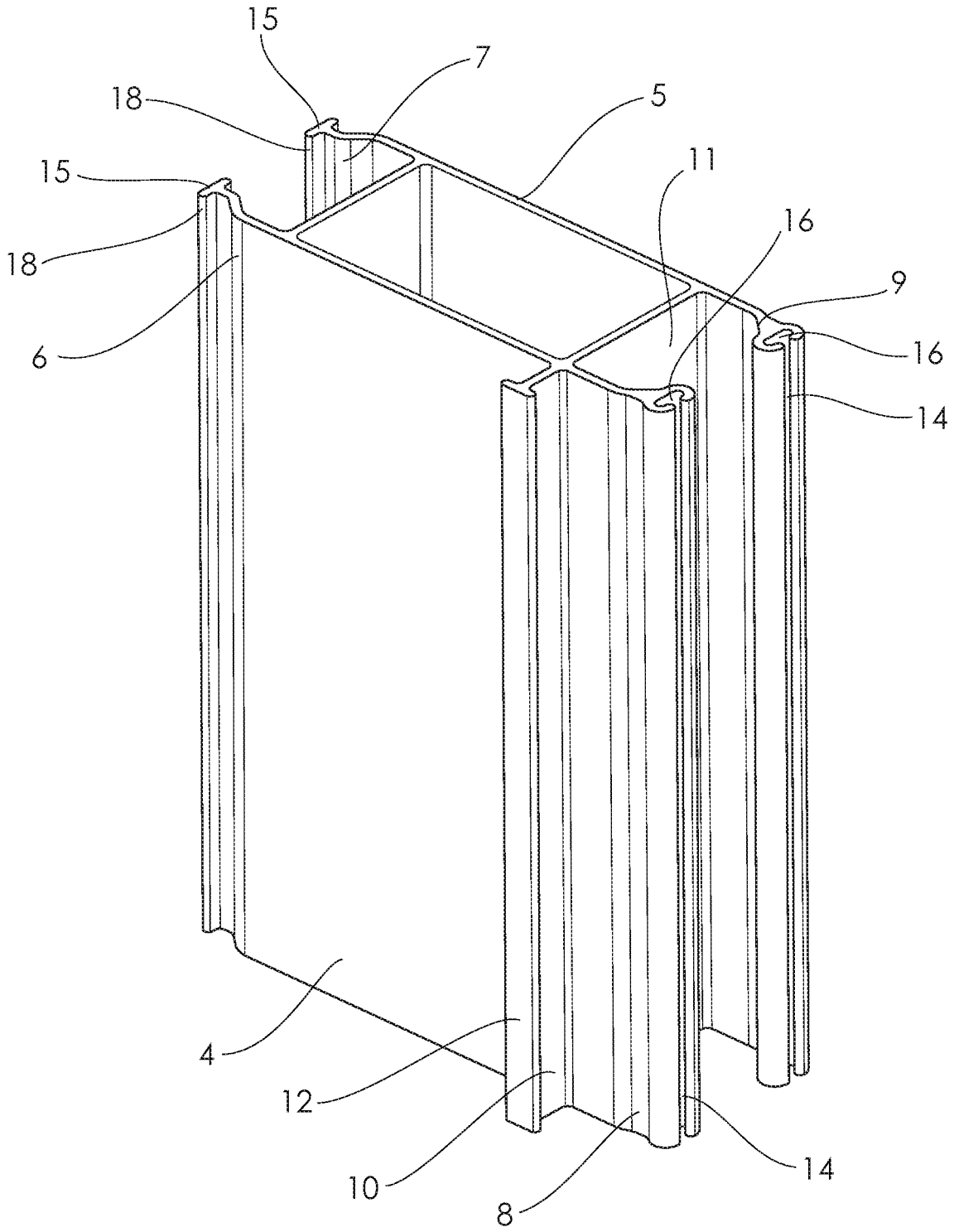
FIG. 2 shows a perspective view of the sheet pile used to construct the walls of FIG. 1.

Referring first to FIG. 1 the Earth Retention Levee System may be constructed in accordance with the invention using two parallel walls 1, 2 constructed from sheet piles. They are driven into the ground 3 at a predetermined angle or batter inward toward each other and to a specified depth of for example 600 mm. Preferably but not essentially the inward slope may be of the order of 5 degrees from the vertical. Each sheet pile as shown in FIG. 2 is preferably of a box section with inside and outside faces 4, 5 and four lateral flanges 6, 7, 8 and 9. A ridge 10 (hereinafter referred to as a gridspine) runs down the inside face 4. The gridspine with this embodiment is offset to one side of the sheet pile and preferably aligns with an internal web 11 for increased strength. The gridspine is also preferably formed with a broadened outer edge 12. The lateral flanges are preferably angled inwardly at the outer ends and are formed into female and male interlocking clutches 14 and 15 on the right and left sides of the pile sheet respectively as shown. The slots 16 defined within the curved arms of the females clutches are shaped and sized in cross-section for a reasonably close tolerance sliding fit over the enlarged splayed edges 18 of the male clutch whereby the pile is adapted during installation to slidably interlock with an adjacent identical pile to form the solid wall structures 1, 2 of closed box sections. By virtue of the aforementioned inward angle of the flange ends the interlocking clutches are set into the wall structure to protect them from damage and also provide a protrusion free surface.

Figure 3:
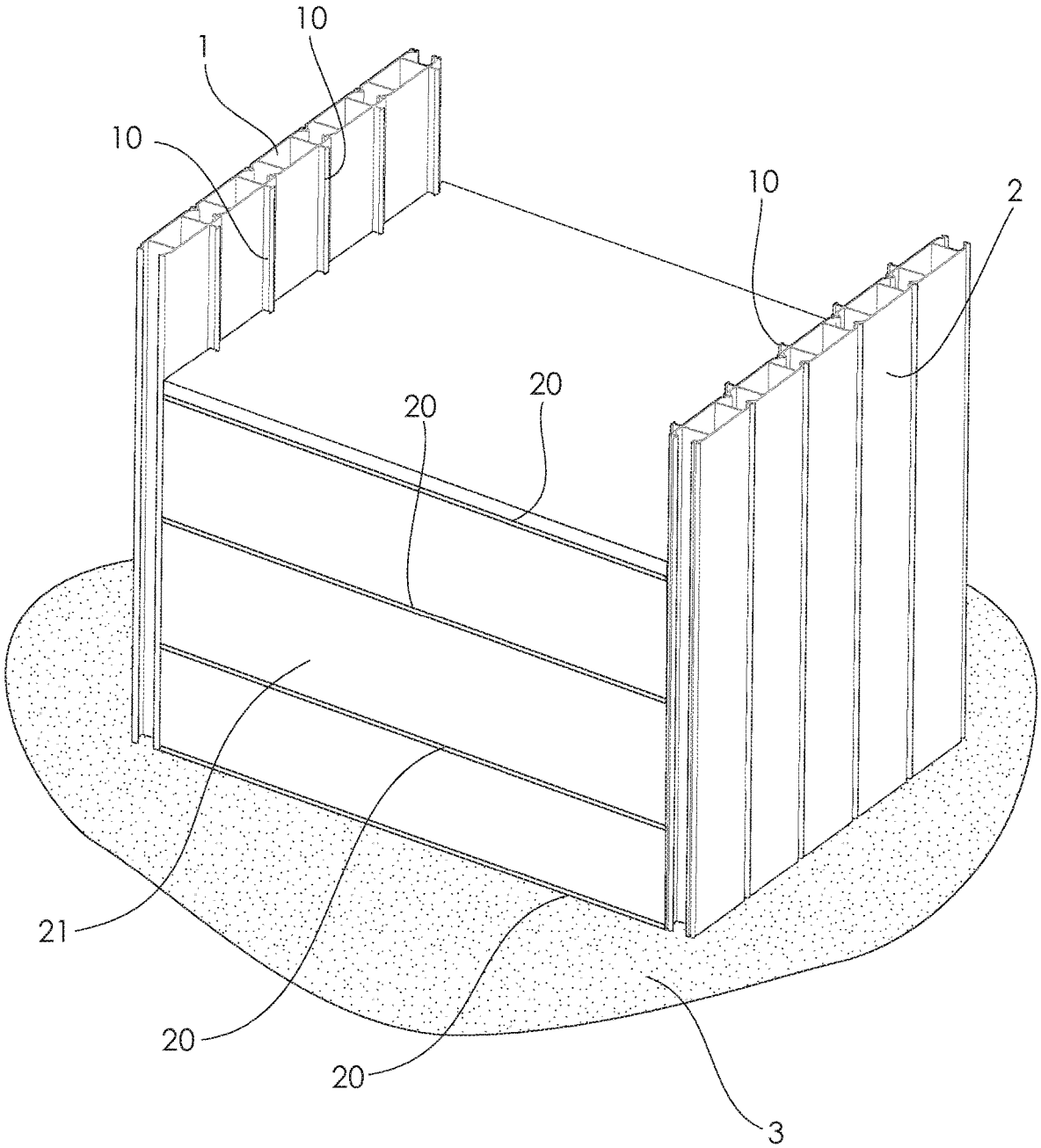
FIG. 3 shows a schematic perspective view of the walls with the geogrid mesh and fill in place.
Figure 4:
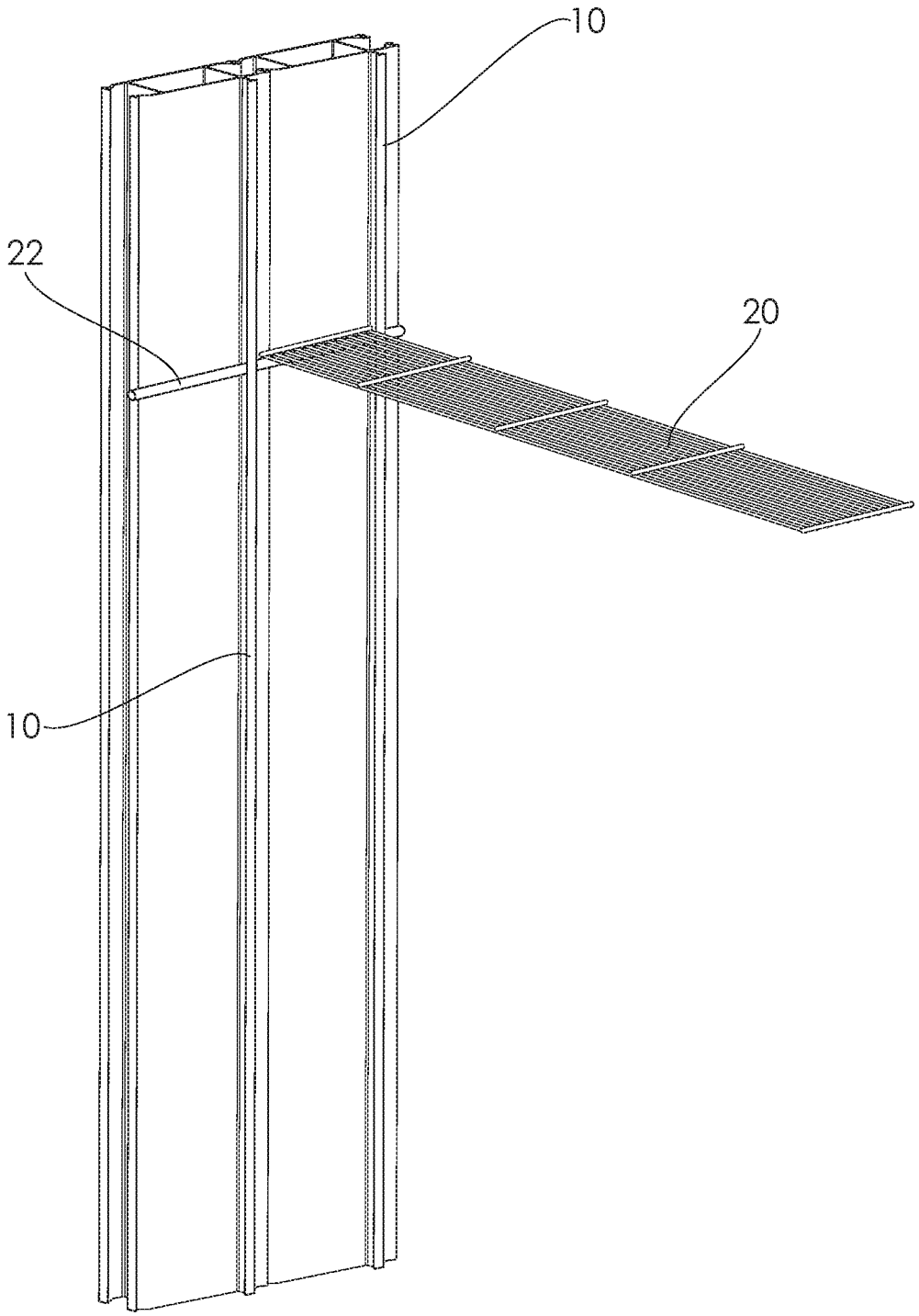
FIG. 4 is schematic perspective view of the inside face of one of the walls showing the preferred method of attaching the geogrid mesh

Typically the walls 1, 2 would run adjacent the course of a river or other low lying area subject to erosion. As shown in FIG. 3 they are connected to each other at their bases and at locations above by reinforcement extending between the piles. This reinforcement preferably comprises the "Geogrid" reinforcement material referred to earlier. The Geogrids 20 are built up in vertically spaced horizontal runs between the walls which are progressively packed in with soil 21 or other suitable fill material. As shown in FIG. 4 the points of connection between the Geogrids and the inside faces of the sheet piles are preferably by means of a composite fibre reinforced polymer rod 22. More specifically, this rod is preferably made of a fibre composite with substantially corrosion resistant vinyl ester resin and E-glass fibre reinforcement. This composite rod allows for a strong corrosion resistant mechanical connection between the sheet pile and the Geogrid. Based on grid placement requirements the gridspine 10 is drilled and the composite rod is inserted through the holes and Grogrid which is then lapped over the rod and preferably fixed with bodkin connectors. This gives the Geogrid a strong positive longitudinal connection to the sheet pile.

After infilling and compacting the fill between the parallel walls 1, 2 as shown in FIG. 3 the vertically spaced runs of Geogrid reinforcement 20 serve to spread the soil load acting on the sheet piles by causing the soil to stack vertically as opposed to stacking at its natural angle of repose. This increases global stability, allows the piles to be constructed from a lighter material while reducing the footprint on waterbody easements. Preferably the infilling occurs progressively from the bottom up with the installation of the reinforcing grids. In accordance with the currently preferred embodiment of the invention the bottom reinforcement grid is secured at the bottom edge of the sheet pile wall and then attached to the other parallel sheet pile wall directly opposite. The fill material 21 is then impacted to a predetermined height above the reinforcement before a subsequent higher vertically spaced horizontal run is attached between the walls. This procedure continues until the required height of infill between the walls is reached.

The piles are installed typically, but not exclusively, by driving them into soil or fill with appropriate pile drivers and the box sections can be subsequently infilled with concrete or other material for added strength.

Preferably, although not essentially, a sheet pile in accordance with this invention may be manufactured by a known process called Pultrusion. This creates fibre reinforced polymer profiles of extraordinary strength and resilience. The reinforcement material is drawn through a liquid thermosetting resin bath. The wet fibrous laminate is then pulled through a heated steel die where precise temperature control cures the material into the profile required. The necessary strength, colour and other characteristics can be designed into the profile by changes in the resin mixture and reinforcement materials.

It will thus be appreciated that this invention at least in the form of the embodiment disclosed provides a novel and improved form of earth retention levee system for retaining walls, sea walls and like structures. Clearly however the example described is only the currently preferred embodiment of the invention and a wide variety of modifications may be made which would be apparent to a person skilled in the art. For example the shape, configuration and dimensions of the sheet pile, the material of which it is constructed and its method of manufacture may change according to application and design preference.

The invention claimed is:

1. An earth retention levee system constructed from:

spaced apart facing parallel walls, each wall of interlocking sheet piles, said sheet piles each in the form of a box section having inside and outside walls and one or more interconnecting webs extending between the inside and outside walls, said outside walls each having an outside face and said inside walls each having an inside face, each inside face formed with a gridspine that extends from the inside face along a longitudinal extent thereof, the inside faces of the spaced apart facing parallel walls facing each other, said gridspines being configured to be connected to adjacent edges of geogrid which are arranged to link said parallel walls and to stabilise fill disposed therebetween in use.

2. The earth retention levee system as claimed in claim 1 wherein said gridspines extend vertically in use.

3. The earth retention levee system as claimed in claim 1 wherein said gridspines are each formed as a continuous flange extending out from said inside face.

4. The earth retention levee system as claimed in claim 3 wherein said gridspines have enlarged or bulbous outer edges.

5. The earth retention levee system as claimed in claim 1 wherein each said sheet pile, on installation, interlocks with another like pile to create a closed wall structure that can be infilled with concrete for increased strength.

6. The earth retention levee system as claimed in claim 1 wherein a number of said geogrids are built up in vertically spaced horizontal runs between said parallel walls in use.

7. The earth retention levee system as claimed in claim 1 wherein said sheet piles are formed from a composite material comprising a fibre reinforced polymer.

8. The earth retention levee system as claimed in claim 7 wherein said composite material includes reinforcement with biaxial E-glass fabrics, continuous strand glass mat and aligned unidirectional rovings.

9. The earth retention levee system as claimed in claim 1 wherein points of connection between said gridspines and geogrids are via rods inserted through holes in said gridspines with edges of said geogrids lapped over said rods.

10. The earth retention levee system as claimed in claim 1 wherein said parallel walls of interlocking sheet piles are driven into a ground area at a predetermined angle inward to each other.

11. The earth retention levee system as claimed in claim 10 wherein said predetermined angle is about 5 degrees.

12. The earth retention levee system as claimed in claim 1 wherein the gridspine is configured to be connected to an adjacent edge of one or more geogrids in use.

13. An earth retention levee system comprising:

at least two parallel walls adjacent to each other and spaced apart, each wall comprising a sheet pile having an outside face and inside face, said sheet pile each in the form of a box section, said outside or said inside face comprising gridspines along a longitudinal extent thereof, each said sheet pile adapted to slidably interlock with an adjacent sheet pile to form wall structures of closed box sections, wherein said gridspines are configured to be connected to adjacent edges of geogrid which are arranged to link said parallel walls and to stabilise fill disposed there between in use.

* * * * *